United States Patent [19]

Naumann et al.

[11] Patent Number: 4,838,161

[45] Date of Patent: Jun. 13, 1989

[54] ARRANGEMENT FOR REVERSING PRESSURE OF CYLINDERS AND ROLLERS IN PRINTING MACHINES

[75] Inventors: Johannes Naumann; Hans-Jürgen Tappert, both of Coswig, German Democratic Rep.

[73] Assignee: Werner Lambertz Leipzig Veb Kombinat Polygraph, Leipzig, German Democratic Rep.

[21] Appl. No.: 926,403

[22] Filed: Oct. 30, 1986

[30] Foreign Application Priority Data

Oct. 31, 1985 [DD] German Democratic Rep. ... 282282

[51] Int. Cl.[4] ..... B41F 13/40

[52] U.S. Cl. ..... 101/247

[58] Field of Search ..... 101/216, 219, 153, 152, 101/247, 352

[56] References Cited

U.S. PATENT DOCUMENTS

| | | | |
|---|---|---|---|
| 2,950,674 | 8/1960 | Taylor et al. | 101/247 X |
| 3,027,832 | 4/1962 | Halley | 101/247 |
| 3,731,620 | 5/1973 | Klemmer | 101/247 |
| 4,119,031 | 10/1978 | Ottenhues | 101/247 |

*Primary Examiner*—J. Reed Fisher

*Attorney, Agent, or Firm*—Michael J. Striker

[57] ABSTRACT

A main hydraulic circuit for controlling printing pressure of a printing machine is supplemented by an auxiliary high pressure generating circuit which becomes effective only after the pressure flow reversal in the main hydraulic circuit. The auxiliary circuit includes a pressure transformer or a hand-operated auxiliary pump connected via a back pressure valve to a hydraulic motor in the main circuit, and a second back pressure valve connected in series with a driving pump in the main circuit.

7 Claims, 3 Drawing Sheets

ARRANGEMENT FOR REVERSING PRESSURE OF CYLINDERS AND ROLLERS IN PRINTING MACHINES

BACKGROUND OF THE INVENTION

The present invention relates in general to printing machines and, in particular, to an arrangement for reversing pressure of cylinders and/or rollers of a printing machine.

From DD Pat. No. 121,301 a device for reversing pressure of cylinders and rollers in a printing machine by means of a pneumatic or hydraulic motor is known.

However, the prior art devices of this kind possess the disadvantage that in the case when several sheets being printed run in the contact zone between a rubber (blanket) cylinder and a plate cylinder, or between the rubber cylinder and an impression cylinder, then printing pressure increases and, consequently a control pressure needed for stopping the printing has an extremely high value which normally cannot be delivered by a conventional hydraulic pressure control circuit designed for a normal operation of the printing machine.

SUMMARY OF THE INVENTION

It is, therefore, a general object of this invention to overcome this disadvantage.

In particular, it is an object of this invention to provide pressure reversing arrangement which enables a reliable application of control pressure for disengaging the rubber or blanket cylinder from the plate cylinder even under the condition of an extremely increased printing pressure between the cylinders and/or rollers of a printing machine.

Another object of this invention is to provide such an improved arrangement which safeguards printing plates on the plate cylinder against damage.

In keeping with these objects and others which will become apparent hereafter, one feature of this invention resides in the provision of an auxiliary pressure generating circuit connected between a flow direction control means and a hydraulic or pneumatic motor driven by a pump of a main control pressure generating circuit. The auxiliary pressure generating circuit can include a hand-operated pump or a source of low pressure supplying a step-up pressure transformer. The auxiliary pressure generating circuit is connected to the hydraulic/-pneumatic motor in series with a back-pressure valve and in parallel with the pump of the main circuit. In a modification, the pressure transformer can be connected parallel to a back-pressure valve and in series with the main pump. The pressure transformer can be a hydraulic, a pneumatic or a combined pneumatic-hydraulic step-up transformer.

The novel features which are considered as characteristic for this invention are set forth in the appended claims. The invention itself, both as to its construction and its method of operation will be best understood from the following description of specific embodiments when read in connection with the accompanying drawing.

DESCRIPTION OF THE PREFERRED EMBODIMENTS

Figure 1:
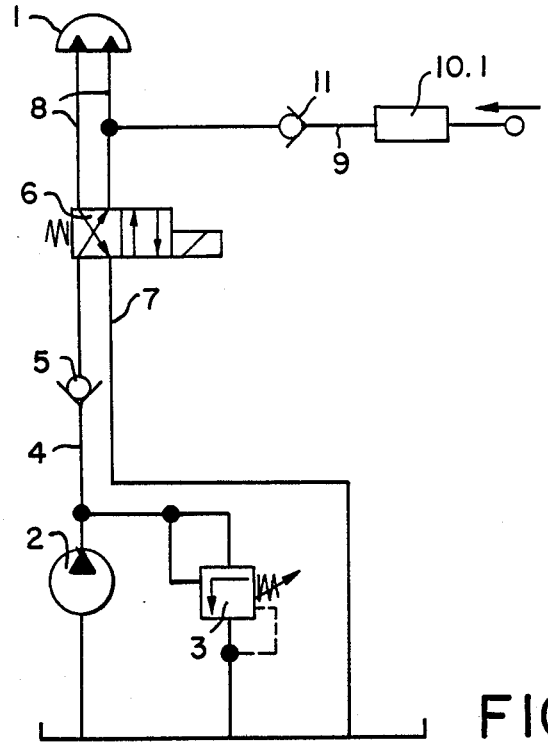
FIG. 1 is a circuit diagram of an embodiment of a hydraulic pressure reversing arrangement of this invention.
Figure 2:
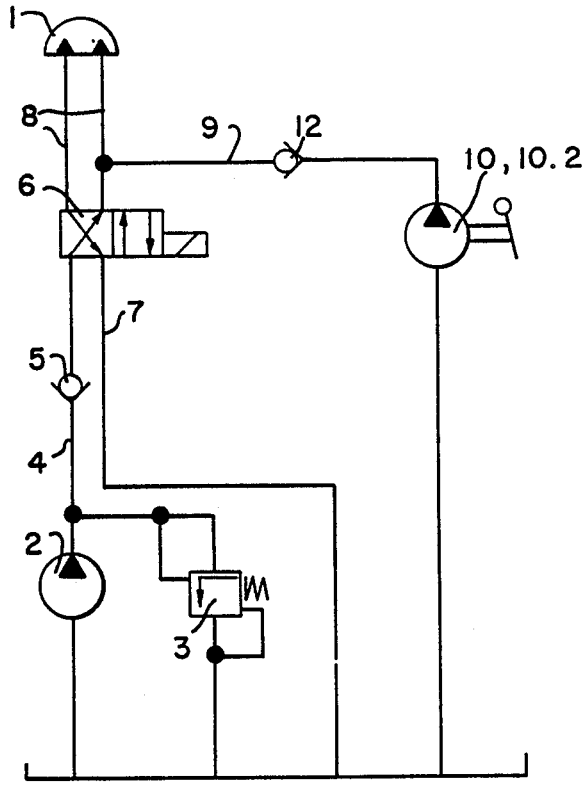
FIG. 2 is another embodiment of the arrangement of this invention.
Figure 3:
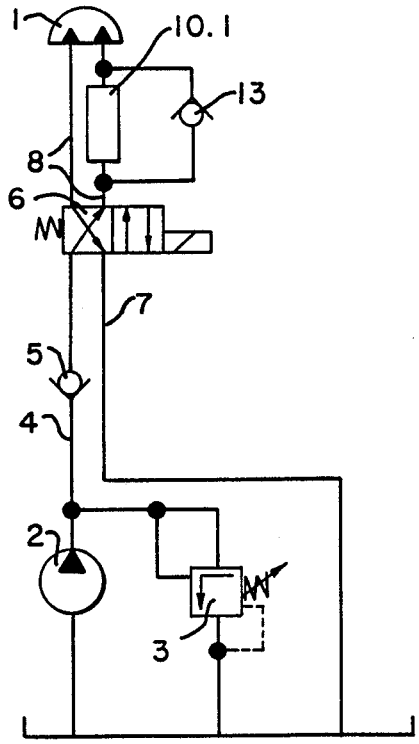
FIG. 3 is a modification of the embodiment of FIG. 1.
Figure 4A:
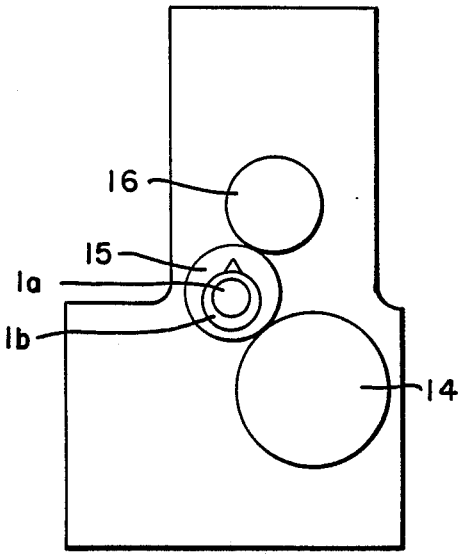
FIG. 4a PRIOR ART.
FIG. 4*a* shows schematically a prior art printing machine in a condition in which pressure is applied to its cylinder.
Figure 4B:
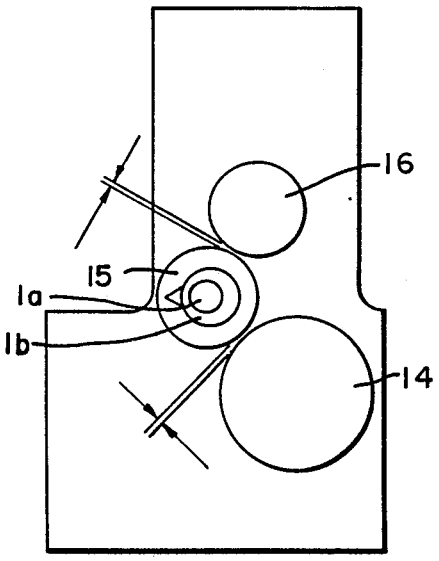
FIG. 4b PRIOR ART.
FIG. 4*b* shows the printing machine of FIG. 4*a* with cylinders in their disengaged condition.

In a prior art printing machine shown in FIGS. 4*a* and 4*b*, drive shaft 1*a* of a reversible hydraulic motor is coupled to eccentric bearing 1*b* of a blanket cylinder 15 for reversibly applying pressure to plate and impression cylinders 16 and 14 of the printing machine. In the disengaged position according to FIG. 4*b*, blanket cylinder 15 is displaced by a distance "a" from impression cylinder 14, and by a distance "b" from plate cylinder 16. Such pressure application means are known from prior art and need not be explained in detail for the purposes of this invention. Referring to FIGS. 1 to 3, the reversible hydraulic motor 1 is driven by a main pressure controlling circuit including a main pump 2 safeguarded by a pressure relief valve 3 against excessive pressure. The pump 2 is connected via a back-pressure valve 5, a delivery conduit 4 and a solenoid controlled directional control valve to one of conduits 8 leading to the inlet port of the reversible hydraulic motor 1. The other conduit 8 in the illustrated pressure reversing position of valve 6, is connected via the outlet port of the motor to return conduit 7.

According to the invention, the other conduit 8 is further connected via a back-pressure valve 11 and a branch conduit 9 to a source of auxiliary high pressure 10 which, in the embodiment of FIG. 1, is a step-up pressure transformer 10.1. In the embodiment of FIG. 2, the auxiliary high pressure source 10 is a hand-operated auxiliary pump 10.2. The step-up pressure transformer is supplied either from a source of a low pressure fluid or other suitable energy storing member.

In the embodiment of FIG. 3, the step-up pressure transformer 10.1 is connected in the other conduit 8 in series with the main pump 2 and is bridged by a back-pressure valve 13. In this arrangement, the valve 13 is oriented for rendering the pressure transformer ineffective during the start or normal operation of the motor. The pressure transformer starts operating only after the shut-off of printing pressure when the flow of pressure fluid is reversed.

When the auxiliary pressure reversing circuit is activated, either by the hand-operated pump 10.2 or by the active pressure transformer 10.1, an auxiliary high pressure is delivered via back-pressure valves 11 or 12 to a motor conduit 8 instead of the lower control pressure from the main pump. Accordingly when printing pressure in the machine excessively increases due to the entry of several sheets into a contact zone between printing plate and blanket cylinders for example, the correspondingly increased control pressure CP for disengaging the blanket cylinder from the plate cylinder on order to stop the printing is delivered by the pressure transformer or by operating the auxiliary pump. In this manner a damage of printing plates on the plate cylinder is avoided.

While the invention has been illustrated and described as embodied in specific examples of a printing pressure control arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for reversing printing pressure of cylinders of a printing machine, comprising a main pressure controlling circuit including a fluid power motor having a fluid inlet port and a fluid outlet port and being coupled to said cylinders; a main pump connected via a back-pressure valve to said inlet port to deliver to the motor a flow of fluid at a requisite control pressure, and flow direction control means arranged between said back-pressure valve and said ports to reverse the direction of the control pressure application to said cylinders; and an auxiliary fluid pressure circuit connected between said outlet port and said direction control means to add an auxiliary high pressure to said motor when said flow direction control means reverses the control pressure on said cylinders.

2. An arrangement as defined in claim 1, wherein said auxiliary pressure circuit includes a series connection of a back-pressure valve with a hand-driven pump connected parallel to said main pump.

3. An arrangement as defined in claim 1, wherein said auxiliary pressure circuit includes series connection of a back-pressure valve with a step-up pressure transformer connected parallel to said main pump.

4. An arrangement as defined in claim 1, wherein said auxiliary pressure circuit includes a parallel connection of a step-up pressure transformer with a back-pressure valve connected between said flow direction control means and said motor.

5. An arrangement as defined in claim 1, wherein said cylinders include a plate cylinder, a blanket cylinder and an impression cylinder, said motor being coupled to said blanket cylinder to disengage the same from said plate cylinder when said flow direction control means reverses the printing pressure.

6. An arrangement as defined in claim 1 wherein said motor is a hydraulic motor.

7. An arrangement as defined in claim 1 wherein said motor is a pneumatic motor.

* * * * *